US008740010B1

(12) United States Patent
Page

(10) Patent No.: US 8,740,010 B1
(45) Date of Patent: Jun. 3, 2014

(54) COOLER WITH LOCKING CAPABILITIES

(71) Applicant: Rex E. Page, Rome, GA (US)

(72) Inventor: Rex E. Page, Rome, GA (US)

( * ) Notice: Subject to any disclaimer, the term of this patent is extended or adjusted under 35 U.S.C. 154(b) by 7 days.

(21) Appl. No.: 13/746,379

(22) Filed: Jan. 22, 2013

Related U.S. Application Data

(60) Provisional application No. 61/588,384, filed on Jan. 19, 2012.

(51) Int. Cl.
*F25D 11/00* (2006.01)

(52) U.S. Cl.
USPC ..... 220/592.03; 220/592.2; 220/212.5; 220/212; 220/770; 190/118; 190/115; 62/457.7; 62/457.1; 16/429; 16/113.1

(58) Field of Classification Search
USPC ..... 62/457.1, 457.5, 457.7; 190/11, 12 A, 190/12 R, 115, 118; 220/212, 212.5, 324, 220/592.03, 592.2, 915.1–915.2, 770; 16/113.1, 429
See application file for complete search history.

(56) References Cited

U.S. PATENT DOCUMENTS

| | | | | | |
|---|---|---|---|---|---|
| 3,395,550 | A | | 8/1968 | Dungan | |
| 4,436,214 | A | | 3/1984 | Henderson | |
| 4,550,931 | A | * | 11/1985 | Ziaylek, Jr. | 280/655 |
| 4,577,475 | A | | 3/1986 | Herrera | |
| 4,724,681 | A | | 2/1988 | Bartholomew et al. | |
| 4,759,431 | A | * | 7/1988 | King et al. | 190/18 A |
| 4,846,493 | A | | 7/1989 | Mason | |
| 4,873,841 | A | | 10/1989 | Bradshaw et al. | |
| 5,011,013 | A | | 4/1991 | Meisner et al. | |
| 5,076,078 | A | | 12/1991 | Weger, Jr. | |
| 5,125,697 | A | | 6/1992 | Kahl et al. | |
| D328,689 | S | | 8/1992 | Riskowski | |
| 5,140,833 | A | | 8/1992 | Whalen | |
| 5,193,706 | A | * | 3/1993 | Hanna et al. | 220/324 |
| 5,249,438 | A | | 10/1993 | Rhaney et al. | |
| 5,295,369 | A | | 3/1994 | Garcia | |
| 5,329,787 | A | | 7/1994 | Friday | |
| 5,373,708 | A | | 12/1994 | Dumoulin, Jr. | |
| 5,499,473 | A | * | 3/1996 | Ramberg | 43/55 |
| 5,553,350 | A | * | 9/1996 | Chang | 16/113.1 |
| 5,671,611 | A | | 9/1997 | Quigley | |
| 5,683,097 | A | * | 11/1997 | Fenton et al. | 280/655.1 |
| D394,955 | S | * | 6/1998 | Dickinson et al. | D3/281 |
| 5,822,916 | A | * | 10/1998 | Power | 43/57 |
| 5,855,309 | A | | 1/1999 | Hallsworth | |
| 6,085,928 | A | * | 7/2000 | Dickinson et al. | 220/324 |
| 6,343,404 | B1 | * | 2/2002 | Kuo | 16/113.1 |
| 6,474,097 | B2 | * | 11/2002 | Treppedi et al. | 62/457.7 |
| 6,736,265 | B2 | * | 5/2004 | Kipper et al. | 206/373 |
| 6,763,678 | B2 | * | 7/2004 | Harper | 62/457.7 |
| D520,734 | S | * | 5/2006 | Henning et al. | D3/281 |
| 7,219,919 | B2 | | 5/2007 | Tipton | |
| D552,426 | S | * | 10/2007 | Jones et al. | D7/605 |

(Continued)

*Primary Examiner* — Mickey Yu
*Assistant Examiner* — Brijesh V. Patel
(74) *Attorney, Agent, or Firm* — Robert C. Montgomery; Montgomery Patent and Design

(57) ABSTRACT

An insulated cooler with an integral padlock system comprises a hinged lid and a padlock receiving loop located on the lid. A second, corresponding receiving loop is disposed on the cooler. When closed, a user can apply a padlock to the first and second receiving loop simultaneously to lock the lid in a closed position to enable a user to leave the cooler unattended while full of food or beverages in a public location and prevent unauthorized persons and animals from getting into the cooler.

18 Claims, 5 Drawing Sheets

(56) References Cited

U.S. PATENT DOCUMENTS

| | | | | |
|---|---|---|---|---|
| 7,389,608 | B1 | 6/2008 | MacKay | |
| 8,256,242 | B1 * | 9/2012 | Evans | 62/457.7 |
| 2007/0001409 | A1 * | 1/2007 | Kaplan | 220/592.2 |
| 2007/0101754 | A1 * | 5/2007 | Maldonado | 220/592.03 |
| 2007/0157635 | A1 * | 7/2007 | Ford | 220/592.03 |
| 2010/0212351 | A1 * | 8/2010 | Chapin et al. | 62/457.5 |
| 2011/0226785 | A1 * | 9/2011 | Sakell | 220/592.2 |

* cited by examiner

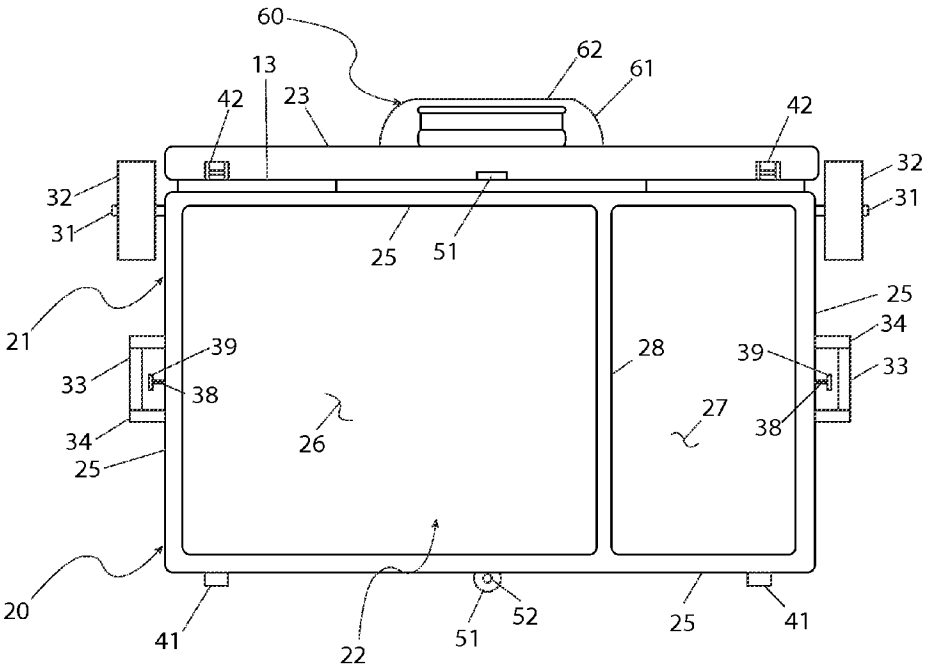
Fig. 2
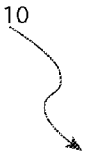

COOLER WITH LOCKING CAPABILITIES

RELATED APPLICATIONS

The present invention was first described in U.S. Patent Provisional No. 61/588,384 filed on Jan. 19, 2012 the entire disclosures of which are incorporated herein by reference.

FIELD OF THE INVENTION

The present invention relates to an insulated container and more specifically, to an insulated container including a compartmentalized interior and having means to secure a lid for the container.

BACKGROUND OF THE INVENTION

Several insulated picnic coolers are provided with a means to clasp a lid of a cooler to a body portion. Clasp mechanisms are designed to generate a closed position by either securing the entire lid to the body portion if the lid is detachable or securing a side of the lid if the lid is hingedly attached. It is often desirable to not only secure the lid to the body, but to also lock it in a closed position. Coolers are often employed in public places and in public settings. The contents of coolers are of a personal nature to impose a reasonable expectation of privacy and security about them. It is desirable to have a portable cooler with a locking mechanism comprising of two (2) hasps that align with each other when the lid of a cooler is in a closed position so that a padlock or similar securing device can be inserted and used to secure the lid for added privacy and security. Another desirable feature is to have coolers provided with a means to maintain a separation between the coolant and the items to be cooled. Often, if no separation exists, the coolant (typically ice water) melts, and the water intermingles with the foodstuff. Just as bothersome, if no separation exists, liquid and juices from the foodstuff tend to contaminate the coolant, forcing users to clean or even discard the coolant. A third desirable feature is to have coolers equipped with a means to drain unwanted, accumulated, fluid without having to over-turn the cooler or bale the fluid.

U.S. Pat. No. 5,125,697 shows a lockable latch for a container comprising of a hinged latch with a slot that is positioned to cover a lock receiving tab. A lock can then be placed through the lock receiving tab to secure the container.

U.S. Pat. No. 7,219,919 shows a security and storage enclosure for a portable cooler employing a locking cable inserted through an eye hook as the security device.

U.S. Pat. No. 3,395,550 shows a cooler that has compartments, where the compartments are designed for one to hold drinking and potable liquid with a dispensing spigot.

U.S. Pat. No. 4,724,681 shows a cooler with a retractable handle, but the handle does not pivot.

U.S. Pat. No. 4,873,841 shows a cooler with a pivoting handle and other carrying handles. It further shows a leveling base and incorporates a drainage system.

U.S. Pat. No. 5,671,611 shows a cooler with a center compartment to house the coolant material, and a surrounding compartment to house the foodstuff and beverages

SUMMARY OF THE INVENTION

The present invention relates to a storage cooler with locking capabilities. The cooler assembly comprises of a relatively light-weight, portable, container made from thermoplastic material exhibiting thermally insulating properties, a partition wall within an interior portion of the cooler, a drainage system, a set of attached wheels for ease of transport, a first handle that is attached and situated to provide a means to pull the cooler on the wheels, a second handle that is attached and situated to provide a means to lift and carry the cooler, a stand that is attached and situated to provide a means to substantially level the cooler on uneven surfaces, a hingegly attached lid, a set of latches to secure the lid, and an integral hasp system.

An important feature of the cooler assembly is that it comprises of an integral hasp system to facilitate the use of a padlock or similar locking device for added security and privacy. The hasp system comprises of a first loop attached to, and protruding from, a surface of the lid and a second loop attached to, and protruding from, a surface of an upper edge of the body of the cooler. When the lid is in a closed position, the two (2) loops abut each other to form an integrated lock receiving loop due to the alignment of the apertures of each loop. A padlock or similar securing device can then be employed to secure the lid by inserting the securing device through the lock receiving loop.

Another beneficial feature of the cooler assembly is the compartmentalization configuration of the interior portion of the cooler. A partition wall separates the two (2) compartments and comprises of a material composition to facilitate and drive any thermally gradient that may exist between the two (2) compartments. It is envisioned that a first compartment would be smaller in volume in relation to a second compartment. It is envisioned that ice or similar coolant materials would be placed in the first compartment and foodstuff or beverages would be placed in the second compartment. The thermal properties of the wall are such to facilitate the transfer of heat from the second compartment to the first compartment. The compartments are also adequately sealed so as to prevent liquids from either compartment infiltrating the other compartment.

Another beneficial feature of the cooler assembly is that each compartment is provided with a drainage system to allow the user to independently drain any unwanted, accumulated, fluid in either compartment.

An optional and preferred feature of the cooler assembly is an extendable handle that is pivotably attached to facilitate maneuverability of the cooler about the attached wheels.

There is a need to have a cooler provided with a partition within the interior cargo space of the cooler to serve as both a separation device and a thermal heat transfer facilitator. A drainage system should be incorporated to allow users to rid of accumulated fluids within the cooler without overturning or baling the cooler. The cooler should also be equipped with a means to secure and lock the cooler for added security and privacy. Being able to exploit all of these features in a single cooler is an appreciable need for cooler users.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 2 is a plan view of the portable and lockable cooler depicted with a lid 23 in an open position revealing an inner compartment of two (2) sections in accordance to the preferred embodiment of the present invention;

DESCRIPTIVE KEY

Figure 1:
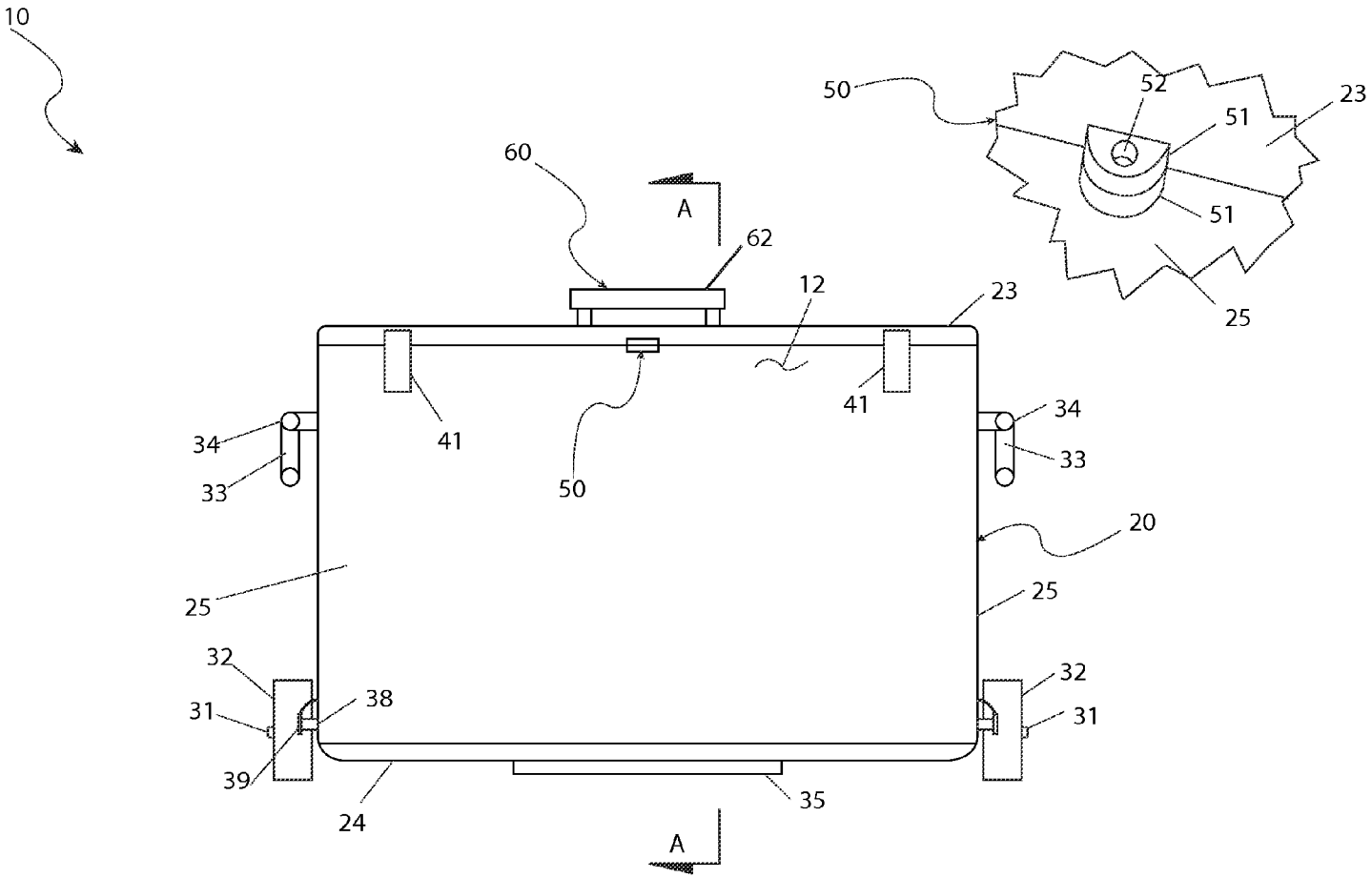
FIG. 1 is a front elevation view of a portable and lockable cooler 10 and an enlarged fragmented perspective view of a lock assembly 32 in accordance to the preferred embodiment of the present invention.

10 portable and lockable cooler
11 upper perimeter edge
12 front wall upper portion
13 lid lip
20 cooler assembly
21 shell
22 interior
23 lid
24 bottom
25 sidewall
26 main compartment
27 ice compartment
28 dividing wall
29 hinge
31 axle
32 wheel
33 side handle
34 handle pivot
35 stand
36 ice compartment
37 dividing wall
38 drain
39 drain plug
41 latch assembly
42 latch strike
50 lock assembly
51 lock receiving loop
52 lock receiving aperture
60 extendable handle assembly
61 handle housing
62 extendable handle
63 extendable handle stop
65 handle slide way
67 slide way plug
70 groove
80 removable dividing wall

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a portable and lockable cooler (herein referred to as the "device") 10, which provides a means to conveniently transport chilled food and/or beverages, and ice from one (1) location to another and place the contents under lock and key to deter unauthorized access.

Referring now to FIG. 1, a front elevation view of the device 10 according to the preferred embodiment of the present invention, is disclosed. The device 10 includes a cooler assembly 20 comprised of an shell 21, a compartment interior 22, and a hinged 29, attached lid 23 that is lockable in a close position. Reference in this embodiment to the front of the device 10 will indicated the sidewall 25 opposite of the hinges 29. The cooler assembly 20 includes a bottom 24 and sidewalls 25 which define a hollow interior 22. The bottom 24 and sidewalls 25 are made of a formed thermoplastic material with thermally insulating properties. A pair of wheels 32 is attached to integrally formed axles 31 on opposing sides of the device 10 at the rear bottom end of the shell 21 for transporting the device 10 without lifting it. An extendable handle assembly 60 is attached to a rear sidewall 25 for pivoting the device 10 on the axles 31 and providing the impetus for motion as well as controlling the direction and speed of travel. A side handle 33 is attached to supportive pivots 34 on each of the opposing narrow sidewalls 25 for lifting or carrying the device 10. A stand 35 is disposed along at least a portion of a front edge of the bottom 24 for maintaining the device 10 at a generally level orientation when it is not pivoted on the axles 32.

The lid 23 is attached to the shell 21 by at least one (1) hinge connection 30. A pair of over-center latch assemblies 41 is deployed along the upper portion 12 of the front sidewall 25 of the shell 21 and can engage the corresponding latch strike 42 located on the lip 13 of the lid 23 to hold said lid closed. The latch assemblies 41 could be comprised of any other suitable cooler latching mechanism, such as hasp type latches, toggle latches, cam latches, or the like without violating the form of this embodiment. A lock assembly 50 extends outwardly from the upper edge of the front sidewall 25 and the lower edge of the front of the lid 23. The lock assembly 50 includes pair of lock receiving loops 51, each of the lock receiving loops 51 having a lock receiving aperture 52. As best seen in the enlarged fragmented perspective view of a lock assembly 50 of FIG. 1, the apertures 52 align when the lid 23 is in the closed and latched position for receiving an external locking mechanism, such as a padlock (not shown).

Figure 5:
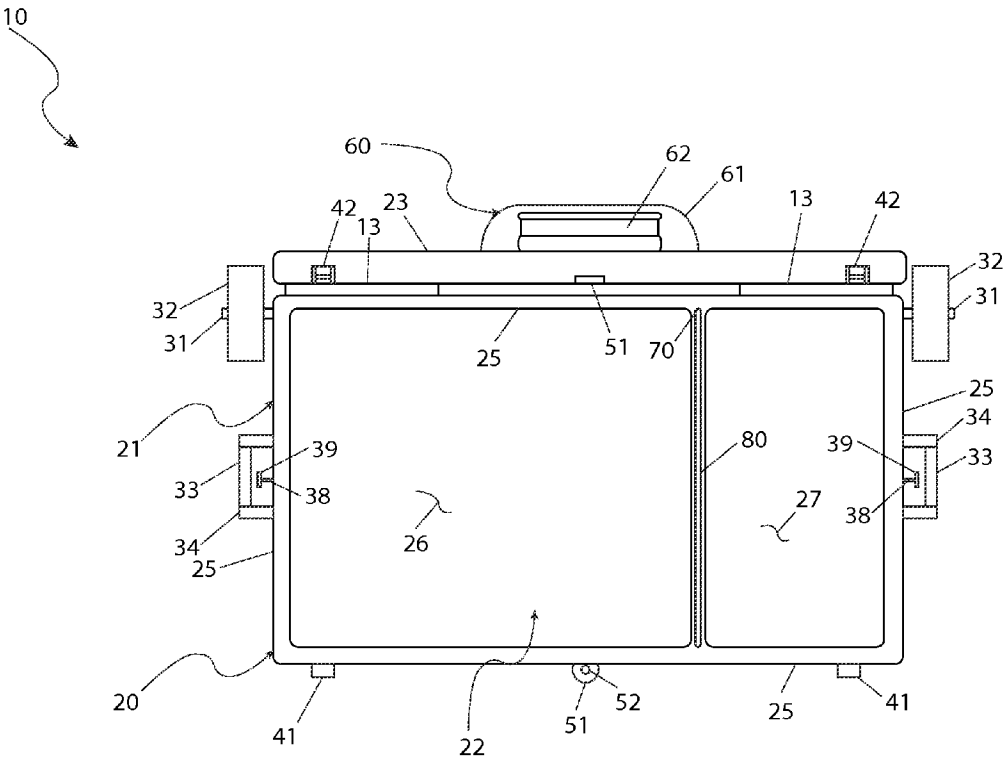

Referring now to FIG. 2, a plan view of the device 10 with the lid 23 in an open disposition according to the preferred embodiment of the present invention, is disclosed. The hollow interior 22 is divided into two (2) unequal compartments, a larger main compartment 26 and a smaller ice compartment 27. The compartments 26 and 27 are separated by a dividing wall 28 which could be formed into the shell 21 at the point of original fabrication. The present form of the preferred embodiment maintains that a thermally conductive material be incorporated into the dividing wall 37. Illustrated in FIG. 5 is an alternative method of compartment separation which could be to form a "groove" 70 in the bottom 24 and the front and rear sidewalls 25, into which a dividing wall 80, comprised of a material that would be a more efficient thermal transmitter, such as an aluminum plate, be installed. Such a dividing wall 80 could be suitably sealed around the bottom 24 and the sidewalls 25 to prevent leakage of any liquid from the shell 21 or between compartments 26 and 27 without violating the form of this invention.

Ice can be placed in the smaller compartment 27 while chilled foodstuffs or beverages are placed in the larger main compartment 27. The presence of the ice will establish a thermal gradient which will prompt sensible heat to move out of the items in the main compartment 26 through the separating wall 37 and into the ice. This division of compartments 26 and 27 and the concurrent sealing around the dividing wall 37 will keep the foodstuffs or beverages from contaminating the ice. An alternative operation of the preferred embodiment would be to place ice in both compartments 26 and 27 while giving no regard to the contamination of the ice in the main compartment 26 and keeping the ice in the ice compartment 27 uncontaminated for any alternate use.

Each of the interior compartments 26 and 27 includes an individual drain 38 formed into the shell 21 and which can be plugged with a pivoting drain plug 39 on the exterior of the shell 21. Each drain 38 is thus connected to its respective compartment 26 or 27 and provides an operable means to independently drain any liquid from the compartments 26 and 27 to the outside of the device 10.

The latch strikes 42 are illustrated in FIG. 2 attached to the lid 23 of the device 10. When the lid 23 is closed, the latch assemblies 41 are able to engage the latch strikes 42 to hold the lid 23 closed and maintain the thermally depressed state of the device.

Figure 3:
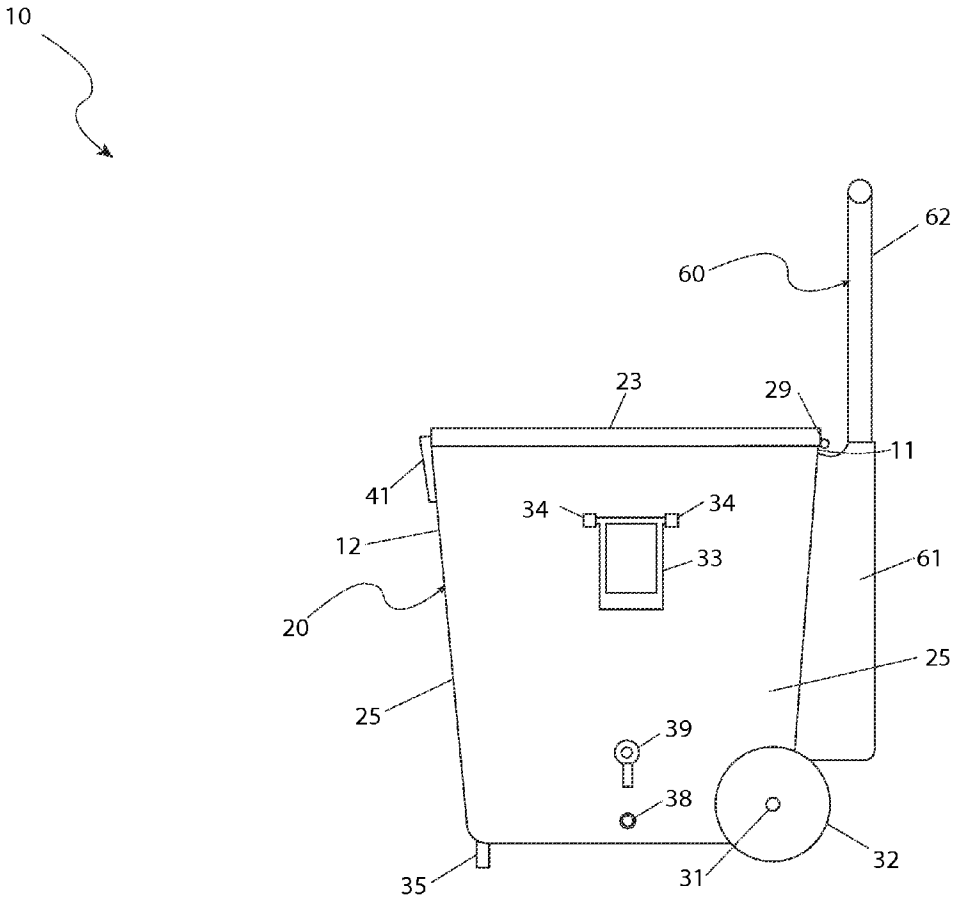
FIG. 3 is a side elevation view of the portable and lockable cooler 10 depicted with an extendable handle 27 in an up position in accordance to the preferred embodiment of the present invention.
Figure 4:
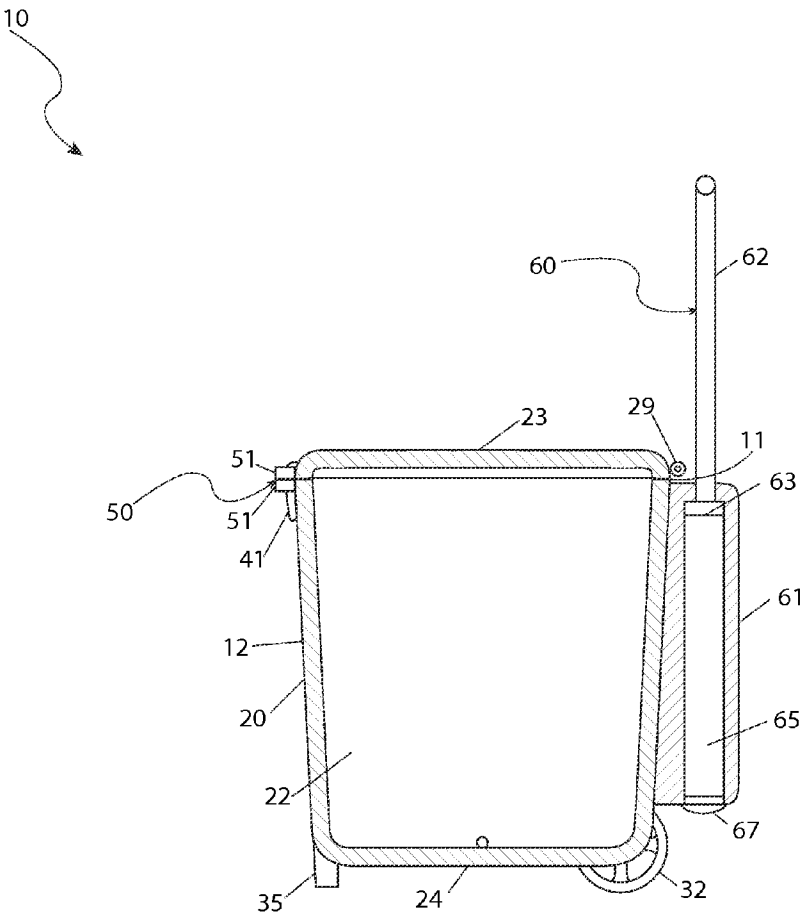
FIG. 4 is a section view of line A-A as shown on FIG. 1 cut through the extendable handle 27 in accordance to the preferred embodiment of the present invention; and, FIG. 5 is a plan view of the portable and lockable cooler depicted with a lid 23 in an open position revealing an inner compartment of two (2) sections in accordance with an alternate embodiment.

Referring now to FIG. 3, a side elevation view of the device 10 according to the preferred embodiment of the present invention, is disclosed. Along with this consider FIG. 4, a section view of the line A-A, as seen on FIG. 1, of the device 10. The device 10 includes an extendable handle assembly 60 comprised of a handle housing 61 with a pair of handle slide ways 65. The handle housing 61 can be integrally molded with the shell 21 during fabrication of the device 10. The extendable handle 62 retracts downwardly within the handle housing 61 when not in use, as seen in FIGS. 1 and 2, and extends upwardly into the up position when in use, as seen in FIGS. 3 and 4. In the illustrated embodiment, the extendable handle 62 includes a pair of vertical supports and a horizontal grip connected between upper ends of the vertical supports. The vertical supports move along the interior vertical handle slide ways 65 formed into the handle housing 61. A pair of handle stops 63 is placed on the ends of the vertical supports of the extendable handle 62 to limit the upward travel of the extendable handle 62. The diameter of the handle slide ways 65 in the handle housing 61 would be large enough to accommodate the handle stops 63 for the majority of the upward travel, but then decrease abruptly to limit the travel and keep the extendable handle from becoming dislodged from the handle housing 61. If the manufacturing tolerances do not provide a sufficient interference fit between the extendable handle 62 and the handle slide ways 65 in the handle housing 61 to retain the extendable handle 62 in the up position while also allowing it to easily be pushed downward when not in use, then a friction locking mechanism can be provided in the handle slide ways 65. A pair of slide way plugs 67 is inserted into the lower open ends of the handle slide ways 65 after the handle stops are installed on the extendable handle 62 at the time of manufacturing to keep out debris or other foreign matter. It is understood that the device 10 may be configured without the extendable handle assembly 60, if desired, thereby providing lift and carry as the only means of transportation.

The preferred embodiment of the present invention can be utilized by the common user in a simple manner with little or no training by performing a series of steps. It can be appreciated that the operational steps can be performed in alternative order and as such any operational description of use should not be viewed as a limiting factor. The first step would, of course, be acquiring a model of the device 10 having the desired storage capacity.

The dual sealed-compartment configuration of the interior 22 and the thermally conductive dividing wall 28 allows the device 10 to perform multiple storage tasks. For example, the main compartment 26 can be used to store various foodstuffs in a dry-cold environment by placing ice or an ice water mixture within the ice compartment 27. The thermally conductive dividing wall 28 transfers heat from the main compartment 26 to the ice compartment 27 to cool the main compartment 26 and foodstuffs held within.

Another example of use is for various foodstuffs to be stored within the main compartment 26 in a wet-cold environment by placing ice or an ice water mix within the main compartment 26 with the foodstuffs. The ice compartment 27 can be used to store clean ice for use with beverages.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A cooler assembly, comprising:

a cooler shell, comprising a bottom wall, a front wall, a rear wall, and a pair of opposing sidewalls to define a box structure;

a compartment interior having a divider wall therein;

a lid hingedly attached to said rear wall at an upper perimeter thereof;

a fastening means for fastening said lid to said front wall;

a pair of wheels each attached to opposing distal ends of an axle integral to and transversing a width of said bottom wall adjacent to a bottom edge of one of said rear wall; and, a handle assembly located on an outer surface of said rear wall, comprising:

a handle housing comprising an integral portion of said rear wall;

a pair of handle slide ways each vertically disposed within said handle housing;

a handle comprising a pair of vertical supports and a horizontal grip connected between upper ends of said pair of vertical supports;

a pair of handle stops located on each lower end of said pair of vertical supports; and a pair of slide way plugs each disposed within lower open ends of said pair of handle slide ways;

wherein each of said pair of vertical supports slidingly moves along an interior of each of said pair of handle slide ways; and, wherein said pair of handle stops limits upward travel of said handle when abutting a tapered portion of each of handle slide ways;

wherein said divider wall is an integral portion of said cooler shell;

wherein said lid is removably secured to an opposing one of said pair of first sidewalls at an upper perimeter edge thereof when in a closed position; and, wherein said cooler shell and said lid comprise an insulating material.

2. The cooler assembly of claim 1, wherein said cooler shell and said lid further comprise a formed thermoplastic material.

3. The cooler assembly of claim 1, further comprising a pair of side handles each attached to pivots on opposing sidewalls and in vertical alignment with each other.

4. The cooler assembly of claim 1, further comprising a stand disposed along at least a portion of a front edge of said bottom wall.

5. The cooler assembly of claim 1, wherein said fastening means is:

a pair of latch assemblies each located adjacent to an upper portion of said front wall;

a pair of latch strikes each located on an outer surface of a lip of said lid;

a first receiving loop located centrally on an outer surface of a lip of said lid; and, a second receiving loop located centrally adjacent to an upper perimeter edge of said front wall;

wherein each of said pair of latch assemblies correspondingly engages one of said pair of latch strikes to secure said lid to said cooler shell;

wherein said first and second receiving loops correspondingly abut each other when said lid is in said closed position to align respective aperture portions; and, wherein said aligned aperture portions is adapted to receive a padlock therein.

6. The cooler assembly of claim 1, wherein said divider wall spans a height between said bottom wall and said lid when in said closed position;

wherein when said lid is in said closed position, said divider wall creates a first compartment and a second compartment isolated from said first compartment.

7. The cooler assembly of claim 6, wherein said first and second compartment each further comprise a drain located in said sidewall and a plug tethered to a pivoting member on a exterior of said sidewall;

wherein said plug seals said drain when inserted therein.

8. The cooler assembly of claim 7, wherein said divider wall further comprises a thermally conductive material incorporated therein.

9. The cooler assembly of claim 7, wherein said first compartment and said second compartment are of unequal volume.

10. A cooler assembly, comprising:

a cooler shell, comprising a bottom wall, a front wall, a rear wall, and a pair of opposing sidewalls to define a box structure;

a compartment interior;

a lid hingedly attached to said rear wall at an upper perimeter thereof;

a fastening means for fastening said lid to said front wall;

a pair of wheels each attached to opposing distal ends of an axle integral to and transversing a width of said bottom wall adjacent to a bottom edge of one of said rear wall; and, a handle assembly located on an outer surface of said rear wall, comprising:

a handle housing comprising an integral portion of said rear wall;

a pair of handle slide ways each vertically disposed within said handle housing;

a handle comprising a pair of vertical supports and a horizontal grip connected between upper ends of said pair of vertical supports;

a pair of handle stops located on each lower end of said pair of vertical supports; and a pair of slide way plugs each disposed within lower open ends of said pair of handle slide ways;

wherein each of said pair of vertical supports slidingly moves along an interior of each of said pair of handle slide ways; and, wherein said pair of handle stops limits upward travel of said handle when abutting a tapered portion of each of handle slide ways;

wherein a divider wall in insertable within a groove located on an interior surface of said bottom wall, said rear wall, and said front wall;

wherein said divider wall is sealed about a seam along said front wall, said bottom wall, and said rear wall;

wherein said lid is removably secured to an opposing one of said pair of first sidewalls at an upper perimeter edge thereof when in a closed position; and, wherein said cooler shell and said lid comprise an insulating material.

11. The cooler assembly of claim 10, wherein said cooler shell and said lid further comprise a formed thermoplastic material.

12. The cooler assembly of claim 10, further comprising a pair of side handles each attached to pivots on opposing sidewalls and in vertical alignment with each other.

13. The cooler assembly of claim 10, further comprising a stand disposed along at least a portion of a front edge of said bottom wall.

14. The cooler assembly of claim 10, wherein said fastening means is:

a pair of latch assemblies each located adjacent to an upper portion of said front wall;

a pair of latch strikes each located on an outer surface of a lip of said lid;

a first receiving loop located centrally on an outer surface of a lip of said lid; and, a second receiving loop located centrally adjacent to an upper perimeter edge of said front wall;

wherein each of said pair of latch assemblies correspondingly engages one of said pair of latch strikes to secure said lid to said cooler shell;

wherein said first and second receiving loops correspondingly abut each other when said lid is in said closed position to align respective aperture portions; and, wherein said aligned aperture portions is adapted to receive a padlock therein.

15. The cooler assembly of claim 10, wherein said divider wall spans a height between said bottom wall and said lid when in said closed position;

wherein when said lid is in said closed position, said divider wall creates a first compartment and a second compartment isolated from said first compartment.

16. The cooler assembly of claim 15, wherein said first and second compartment each further comprise a drain located in said sidewall and a plug tethered to a pivoting member on a exterior of said sidewall;

wherein said plug seals said drain when inserted therein.

17. The cooler assembly of claim 16, wherein said divider wall further comprises a thermally conductive material incorporated therein.

18. The cooler assembly of claim 16, wherein said first compartment and said second compartment are of unequal volume.

* * * * *